United States Patent [19]

Castner, Sr. et al.

[11] Patent Number: 4,888,188

[45] Date of Patent: Dec. 19, 1989

[54] DISPOSABLE FOOD FEEDER PACKAGE

[76] Inventors: John F. Castner, Sr., 1696 W. Mill St., #4, Colton, Calif. 92324; John F. Castner, Jr., 1507 Indian Trail, San Bernardino, Calif. 92407

[21] Appl. No.: 191,356

[22] Filed: May 9, 1988

[51] Int. Cl.[4] ..... B65D 17/50; B65D 53/08; B65D 85/72; B65D 37/00

[52] U.S. Cl. ..... 426/109; 426/110; 426/115; 426/123; 426/117; 30/125; 30/141; 30/123.3; 222/107; 222/106; 222/146.2; 126/263

[58] Field of Search ..... 426/115, 110, 109, 112, 426/117, 123; 30/123.3, 128, 125, 141, 324, 140, 123; 222/94, 106, 107, 192, 146.2; 126/263

[56] References Cited

U.S. PATENT DOCUMENTS

| | | | |
|---|---|---|---|
| Re. 29,916 | 2/1979 | Schmid et al. | 426/117 |
| D. 191,387 | 9/1961 | Hansen . | |
| D. 267,537 | 1/1983 | Borer . | |
| 277,924 | 5/1883 | Pelkey . | |
| 303,212 | 8/1884 | Cochran . | |
| 427,254 | 5/1890 | Danielowsky . | |
| 878,524 | 2/1908 | Gregory | 30/123.3 |
| 2,453,525 | 11/1948 | McNeill | 30/125 |
| 2,550,210 | 8/1949 | Vance, Jr. | 122/320 |
| 2,628,911 | 2/1953 | Horan | 426/117 |
| 2,688,243 | 9/1954 | Bowen | 68/212 |
| 2,792,149 | 5/1957 | Lutz | 222/107 |
| 2,795,043 | 6/1957 | Fleischer | 30/123 |
| 2,837,822 | 6/1958 | Wille | 30/125 |
| 2,953,170 | 9/1960 | Bush | 30/141 |
| 3,090,071 | 5/1963 | Brooy | 222/107 |
| 3,116,152 | 12/1963 | Smith | 426/115 |
| 3,117,874 | 1/1964 | Horan | 426/117 |
| 3,154,418 | 10/1964 | Lovell et al. | 99/77.1 |
| 3,235,128 | 2/1966 | Hansen | 222/107 |
| 3,259,132 | 11/1963 | Katter | 128/344 |
| 3,288,334 | 11/1966 | Corsette | 222/107 |
| 3,356,095 | 12/1967 | Tylle | 222/106 |
| 3,356,263 | 12/1967 | Monroe | 222/107 |
| 3,394,018 | 7/1968 | Velonis et al. | 426/117 |
| 3,410,457 | 11/1968 | Brown | 30/125 |
| 3,428,099 | 9/1966 | Tenenhouser | 141/380 |
| 3,462,061 | 8/1969 | Shore | 426/115 |
| 3,473,221 | 10/1969 | Flanders | 30/141 |
| 3,523,026 | 8/1970 | Emerson et al. | 426/117 |
| 3,635,724 | 1/1972 | Schaar | 426/117 |
| 4,057,047 | 11/1977 | Gossett | 126/263 |
| 4,077,390 | 3/1978 | Stanley et al. | 126/263 |
| 4,093,067 | 6/1978 | Hollander | 426/109 |
| 4,192,360 | 3/1980 | Rodriquez | 141/24 |
| 4,193,506 | 3/1980 | Trindle et al. | 426/117 |
| 4,572,158 | 2/1986 | Fiedler | 126/263 |
| 4,637,934 | 1/1987 | White | 426/117 |

FOREIGN PATENT DOCUMENTS

| | | | |
|---|---|---|---|
| WO80/02875 | 12/1980 | PCT Int'l Appl. | 30/141 |
| 697723 | 9/1953 | United Kingdom | 426/120 |

*Primary Examiner*—Steven Weinstein

*Attorney, Agent, or Firm*—Hill, Van Santen, Steadman & Simpson

[57] ABSTRACT

An inexpensive disposable sanitary sealed food package extrudes paste-like food products to a feeder implement, such as a spoon, fork, or projecting knife therefrom. The package is in the form of a squeeze tube with a nozzle discharging to the feeder implement on the tube. A shrink wrap plastic seal covers the dispensing end of the tube and implement and may directly seal the nozzle or carry a plug seated in the nozzle. The squeeze tube has longitudinal stiffening ribs so that the tube will act as a handle for the feeder implement projecting therefrom. A chemical heat pack activated by bending the tube may be suspended in the tube.

7 Claims, 2 Drawing Sheets

DISPOSABLE FOOD FEEDER PACKAGE

FIELD OF THE INVENTION

This invention relates to the art of sanitary sealed disposable food feeder packages with attached food handling implements and specifically deals with squeeze tubes having such implements sealed and projecting forwardly therefrom to receive material extruded from the tube wherein the tube is stiffened axially to provide a handle for the implements and mounts a chemical heat pack actuated by bending the tube for heating the contents therein.

BACKGROUND OF THE INVENTION

While food feeders for babies, invalids and the like are known in the art, they have usually been in the form of utensils filled from other packages thus presenting a sanitation problem or being too expensive for single disposable use.

It would therefore be an improvement in this art to provide inexpensive disposable food packages with food handling implements that are sanitary sealed until ready for use so that a unitary food package and feeder can be displayed and sold in the manner of canned food products and even suspended on display panels. The packages of this invention can thus be merchandised in the same manner as conventional tubular products.

SUMMARY OF THE INVENTION

According to this invention there is provided an inexpensive single use disposable squeeze tube package for paste-like materials, such as baby food purees, sauces, peanut butter and the like with a feeder implement such as a spoon, fork, or knife projecting therefrom to receive material extruded from the tube as it is squeezed. At least the feeder implement end of the tube is sealed with a shrink wrap film which can also seal the nozzle outlet of the tube. The portion of the tube containing the nozzle and having the feeder implement projecting therefrom is relatively stiff but the remainder of the tube rearwardly from the nozzle end is pliable so that as it is squeezed, the contents of the tube will be forced through the nozzle. The tube preferably has stiff longitudinal ribs along the length thereof that will sufficiently stiffen the tube so as to provide a handle for the feeder implement.

The tube is preferably cylindrical with a flattened sealed tail end from which is suspended in the central interior of the tube, a chemical heat pack to heat the contents of the package. This heat pack can be of the type disclosed in the Stanley et al U.S. Pat. No. 4,077,390, issued Mar. 7, 1978, and the Fiedler U.S. Pat. No. 4,572,158, issued Feb. 25, 1986. Such heat packs have a sealed flexible plastics material bag or tube filled with an aqueous sodium acetate solution and containing a ferrous metal, such as stainless steel, activator strip with shear cuts that can be opened up when the strip is bent or flexed to expose terminus activator points initiating exothermic crystallization of the salt solution thereby generating heat to the zones surrounding the package. Since, according to this invention, the heat pack container is preferably a tube surrounded by the contents of the package, the heat generated will quickly warm the surrounding contents.

The nozzle of the tube may be sealed by a plug or cap which is carried by or is part of a shrink film cover and seal embracing the feeder implement of the tube.

The package may be formed of conventional pliable plastics material of the type used for toothpaste tubes. Such material can be molded into a flexible tube with a stiff nozzle end having a feeder implement projecting therefrom to receive material extruded from the nozzle and a flat sealed rigid rear end. To prevent collapse of the tube between the front and rear end, internal longitudinal ribs or thickened zones are connected to the tube ends so that the length of the tube can act as a handle for the feeder implement. The sealed end of the tube can suspend the heat pack tube with the activator strip of the heat pack so arranged that bending of the rear end of the tube will expose the fissures to the salt solution to initiate the exothermic crystallization.

A suitable plastics material for the tube and feeder implement is a polyethylene terephthalate. A suitable shrink sealed material is a polyolefin or polyvinyl chloride film. Likewise, the container of the heat pack can be a polyvinyl chloride film.

BRIEF DESCRIPTION OF THE DRAWINGS

A preferred embodiment of the invention is illustrated in the attached drawings in which.

BRIEF DESCRIPTION OF THE PREFERRED EMBODIMENTS SHOWN IN THE DRAWINGS

Figure 1:
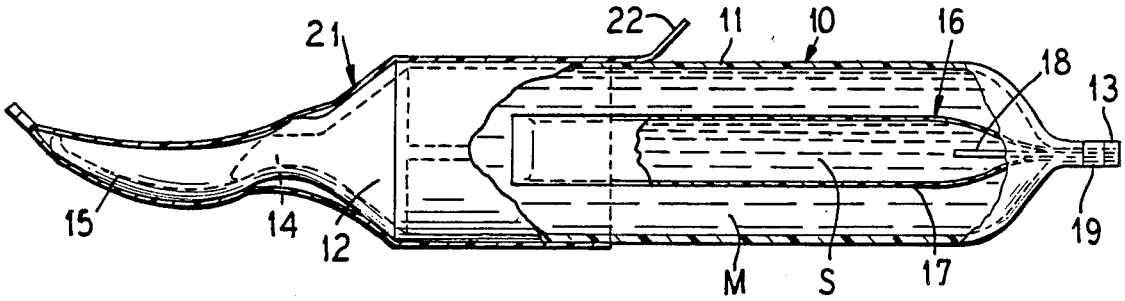
FIG. 1 is a side elevational view of the feeder package of this invention with parts broken away to show underlying parts.
Figure 2:
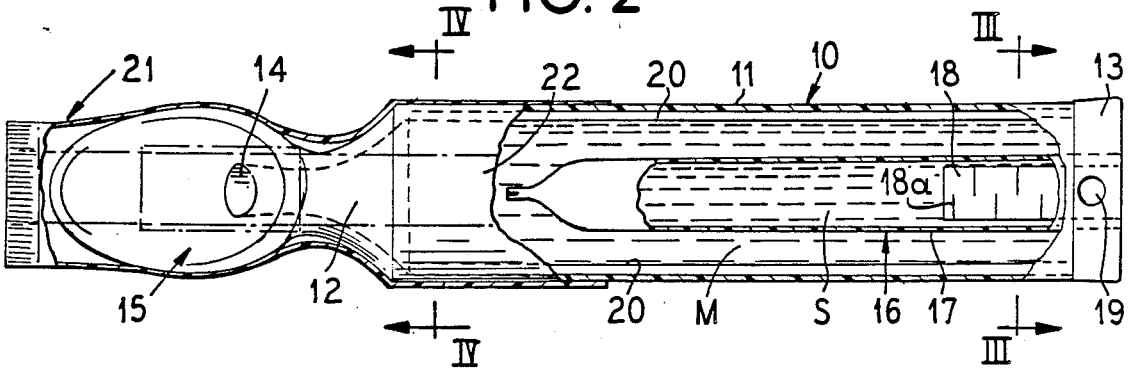
FIG. 2 is a top plan view of the feeder package of FIG. 1 with parts broken away to show underlying parts.
Figure 3:
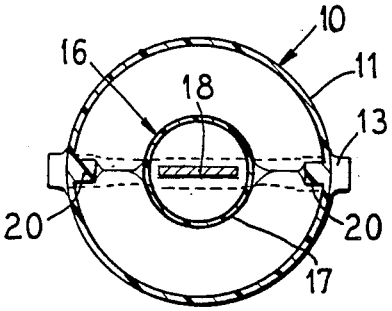
FIG. 3 is a transverse sectional view along the lines III—III of FIG. 2.
Figure 4:
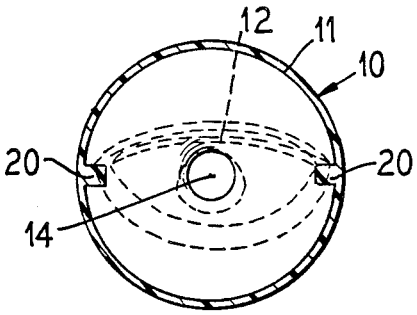
FIG. 4 is a transverse sectional view along the line IV—IV of FIG. 2.

The reference numeral 10 of FIGS. 1 and 2 designates a disposable food feeder package of this invention having a pliable elongated tubular body 11 with a stiff conical front end or neck 12 and a flat transverse rear sealed end 13. The portion of the tube between the front end 12 and rear end 13 is squeezable to collapse the tube and extrude paste-like material M filling the tube through an axial nozzle 14 through the neck 12. This nozzle 14 discharges to a spoon 15 integrally molded on the apex of the conical front end or neck 12 of the tube. The bowl of the spoon 15 lies in a plane parallel to the sealed rear end 13.

A tubular heat pack 16 is suspended axially in the tube 11 surrounded by the material M thereon. This heat pack 16 has a sealed plastic film tubular housing 17 filled with an aqueous solution of sodium acetate S and housing at its rear end a shear cut or lanced ferrous metal activator strip or button 18. The rear end of the tubular housing 17 is sealingly attached to the transverse sealed end 13 of the tube and the arrangement is such that a flexing of the tube 11 adjacent this sealed rear end 13 will bend the strip 18 to open up fissure points at the lanced or shear cuts 18*a* to initiate crystallization of the salt thus causing an exothermic reaction which will heat the tube 17 and the contents M surrounding the tube.

The transverse sealed end 13 of the tube may have a hanger hole or aperture 19 therethrough permitting the tube 11 to be suspended from a display hook or the like.

To prevent collapse or folding of the pliable tube 11 when squeezing out the contents M to the spoon 15, internal longitudinal diametrically opposite ribs 20 connecting the stiff conical front end 12 with the stiff transverse rear end 13 are molded into the tube interior. These ribs 20 will not interfere with squeezing of the tube 11 to extrude the contents M.

The front end 12 of the tube including the spoon 15 and part of the pliable tube portion 11 is covered with a shrink wrap tube 21 which tightly embraces and seals the spoon 15, front end 12, and the front portion of the tube 11 in tight fitting intimate contact therewith. This shrink film seal 21 preferably has a tear strip 22 to remove the seal giving access to the discharge orifice end of the nozzle 14 and permitting the contents of the tube to be squeezed onto the spoon 15.

Figure 5:
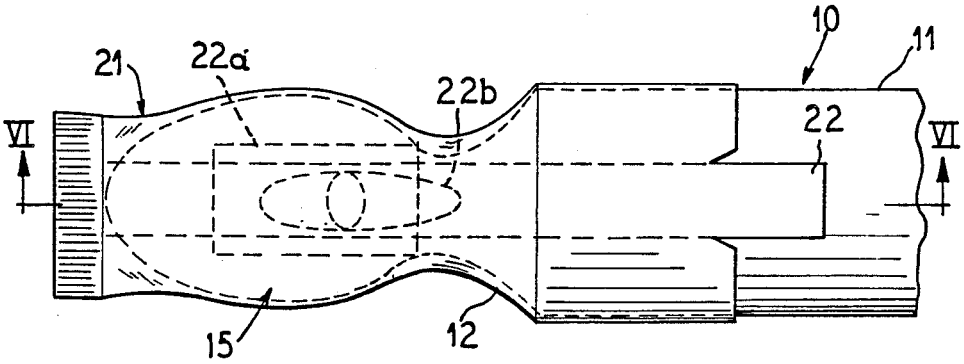
FIG. 5 is a fragmentary plan view of a modified seal for the feeder package.
Figure 6:
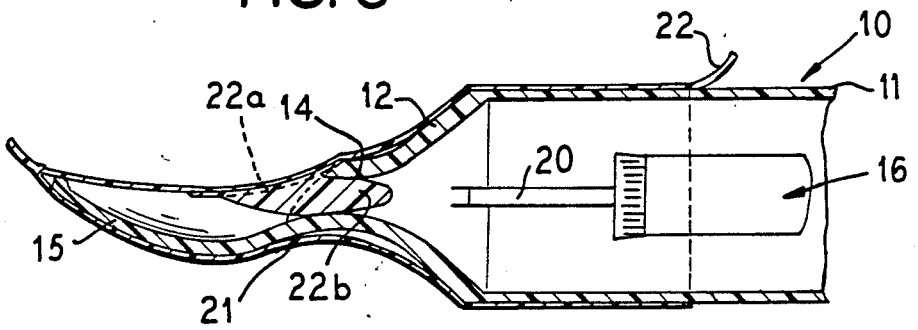
FIG. 6 is a longitudinal sectional view along the line VI—VI of FIG. 5.

The discharge orifice end of the nozzle 14 can be directly sealed by the tear strip 22 by pressing the portion of the strip overlying the orifice against the orifice or as shown in FIGS. 5 and 6, the strip 22 can carry a sealing plug patch 22*a* with a nose 22*b* pressed into the orifice 14. Since the patch is carried by the tear strip 22 of the shrink wrapped seal 21, when the strip is torn out of the seal, the nose will be pulled out of the orifice.

Figure 7:
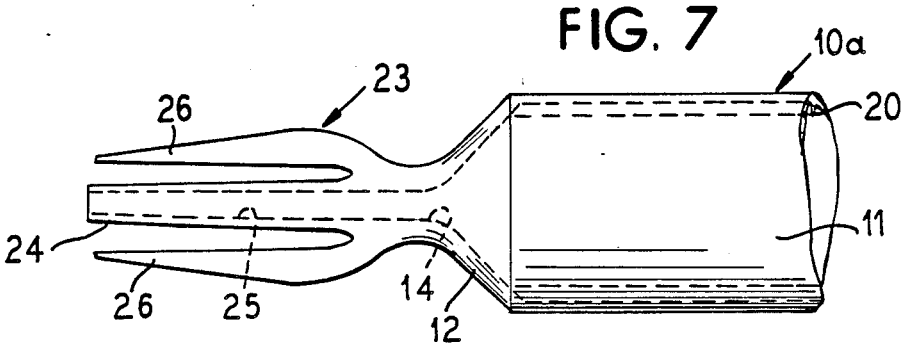
FIG. 7 is a fragmentary plan view of a fork feeder implement for the package.

In a modification shown in FIG. 7, a feeder package 10*a* of this invention constructed as described hereinabove in connection with the embodiment 10, and having identical parts marked with the same reference numerals, in place of the spoon 15, has a fork 23 on the apex end of the conical front 12 of the tube 11. The fork 23 has a central tine 24 with a passage way 25 therethrough communicating through the nozzle 14 with the interior of the tube 11 and adapted to discharge the contents of the tube, such as mustard or ketchup, directly onto the food as it is picked up by the fork. Additional tines 26 straddle the hollow central tine 24 and cooperate therewith in picking up the food.

Figure 8:
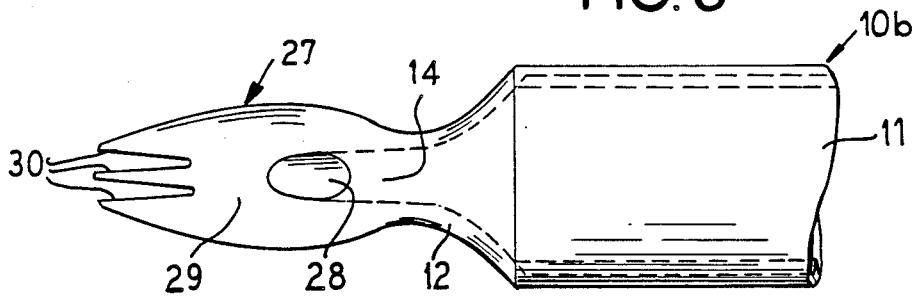
FIG. 8 is a fragmentary plan view of a modified fork feeder implement.

In a further modification 10*b*, as shown in FIG. 8, a fork implement 27 has an outlet orifice 28 discharging on top of the body 29 of the fork above the tines 30 so that the contents of the tube 11 will flow through the nozzle 14 of the conical front end 12 above food picked up by the tines 30 there facilitating discharge of a paste-like condiment on top of the piece of food engaged by the tines.

Figure 9:
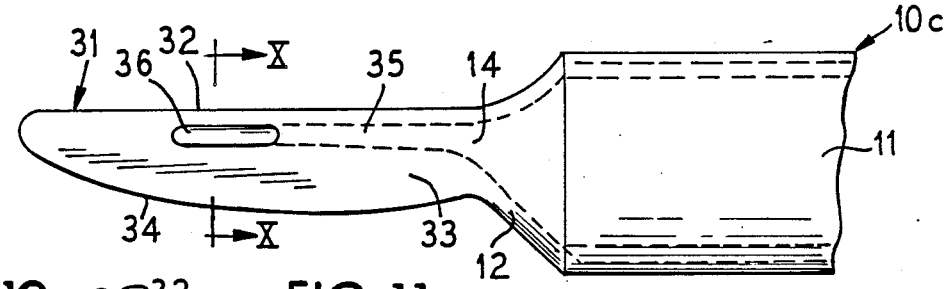
FIG. 9 is a fragmentary side elevational view of a knife feeder implement.
Figure 10:
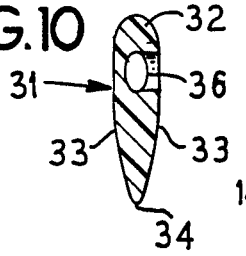
FIG. 10 is a transverse sectional view along the line X—X of FIG. 8.

In another embodiment 10*c*, shown in FIGS. 9 and 10, a knife implement 31 is molded on the apex of the stiff front end 12 of the tube 11. This knife 31 has a conventional rounded or dull back 32 with side faces 33 converging to a knife edge 34. The top portion 32 of the knife has a longitudinal passage 35 leading to the nozzle 14 of the front end 12 tube and discharging near the front end of the knife through an elongated slotted orifice 36. In this arrangement the contents of the tube 11 can be extruded to one side 33 of the knife through the orifice 36 and serve to feed spreadable contents of the tube, such as butter, mayonnaise and peanut butter, to a face 33 of the knife to facilitate use of the knife in spreading the material.

Figure 11:
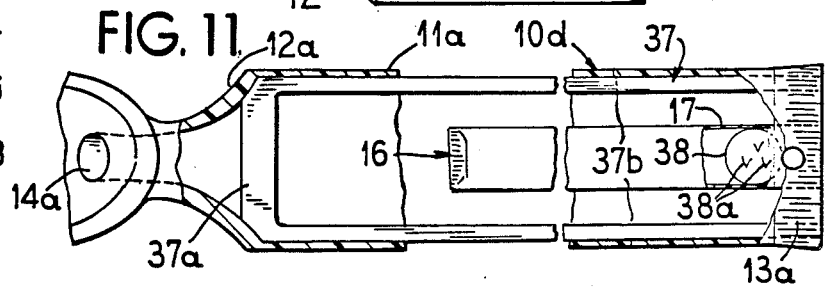
FIG. 11 is a fragmentary plan view with parts broken away similar to FIG. 2 but showing another modification with a separate stiffening rib inserted in the tube to provide a handle.

In still another embodiment 10*d*, shown in FIG. 11, in place of the integral stiffening ribs 20 for the tube 11, a squeezable tube 11*a* without the ribs 20 receives a U-shaped rib insert 37 molded in one piece from stiff high density polyethylene or the like material. The insert has a bight 37*a* bottomed in the front end 12*a* of the tube and spanning but not blocking the nozzle 14*a*. Elongated legs 37*b* of the insert engage the inside of the tube in diametrically opposed relation along the tube length. The ends of the legs 37*b* are secured in the sealed end 13*a* of the tube. This insert 37 serves the same purpose as the ribs 20 and makes possible the use of a conventional toothpaste type tube for the package 10*d*. The heat pack 16 has a modified metal activator button 38 in the housing tube 17 pinched with the housing in the sealed end 13*a* of the tube 11*a* so as to be suspended in the housing 17 adjacent the end 13*a*. The metal button 38 has kerfs 38*a* lanced therein and when the button is deformed by bending the tail end of the tube 11*a* these kerfs will open up to expose activator points to initiate the exothermic crystallization of the sodium acetate in the tube 17.

From the above description and illustrations it should therefore be clearly understood that this invention provides a single use disposable feeder package for flowable paste-like materials, such as food stuffs and condiments, which can be displayed and sold in the same manner as conventional packaged goods including suspension from display hooks. The feeder implements of the package can be in the form of spoons, forks, and knives and heat packs can be provided in the package to heat the contents before dispensing it to the feed implement. The dispensing end of the package is sealed and covered by a removable film thus insuring hygienic sterile handling of the contents of the package.

We claim as our invention:

1. A single use disposable food feeder package comprising an elongated squeeze tube and a flowable food material contained therein, said squeeze tube being squeezable to collapse the tube and extrude said food material, said squeeze tube having a stiff hollow neck at one end thereof with a rigid food handling implement selected from the group consisting of a spoon, a fork, and a knife integral with and projecting therefrom, and a stiff rigid transverse seal on the other end of the tube, a pair of diametrically opposed stiff longitudinal ribs connecting the neck and seal and configured and arranged sufficient to hold the tube in an elongated unfolded condition when the tube is squeezed sufficient to provide a handle for said implement, a shrink wrap plastic sheath covering and sealing said stiff hollow neck and said implement, a plug closing said hollow neck for sealing the contents of the tube, and said sheath having a portion carrying said plug whereby removal of the sheath pulls the plug out of the neck and separates the sheath from the neck and implement for discharge of the flowable food material through the neck onto the implement when the tube is squeezed.

2. The package of claim 1 including a sealed heat pack suspended in the tube from the rigid transverse seal end of the tube adapted to be activated when said seal end of the tube is flexed relative to the tube.

3. The package of claim 1 wherein said transverse seal end has a hole therethrough to receive a hanger pin for suspending the tube from a holder.

4. The package of claim 1 wherein the sheath has a tear strip portion attached to the plug.

5. A food feeder package comprising a longitudinally elongated squeeze tube and a flowable food material contained therein, said squeeze tube being squeezable to collapse the tube and extrude said food material, said squeeze tube having a stiff hollow neck at one end thereof carrying a rigid food handling implement selected from the group consisting of a spoon, a fork, and a knife projecting therefrom, and a nozzle for discharging food from the squeeze tube onto the implement, a stiff sealed transverse rear end on said tube longitudinally spaced from said neck, a pair of diametrically opposed longitudinal ribs connecting the outer ends of the transverse end with the stiff neck and configured and arranged sufficient to maintain the original length of the tube between the stiff neck and the stiff rear end when the tube is squeezed sufficient to provide a handle for the implement onto the neck, a sealed heat pack in the tube having a bendable actuating device therein and suspended from said transverse rear end, said transverse rear end being bendable relative to said tube and heat pack for bending the actuating device in the heat pack to initiate an exothermic action in the heat pack for heating the food contents of the tube, a heat shrink sheath covering and sealing said one end of the tube, the neck and the implement, and a seal in the shrink sheath closing said nozzle.

6. The package of claim 5 wherein the heat pack comprises a plastic bag suspended from said rigid transverse seal end of the tube in the longitudinal center of the tube and said bag is filled with a solution adapted to crystalize and release heat to the contents of the tube.

7. The package of claim 5 wherein the sheath has a tear strip portion carrying the seal.

* * * * *